United States Patent [19]

Hayashi

[11] Patent Number: 4,648,356

[45] Date of Patent: Mar. 10, 1987

[54] EVAPORATIVE COOLING SYSTEM OF INTERNAL COMBUSTION ENGINE

[75] Inventor: Yoshimasa Hayashi, Kamakura, Japan

[73] Assignee: Nissan Motor Co., Ltd., Yokohama, Japan

[21] Appl. No.: 742,318

[22] Filed: Jun. 7, 1985

[30] Foreign Application Priority Data

Jun. 12, 1984 [JP] Japan ..... 59-120112

[51] Int. Cl.[4] ..... F01P 3/22

[52] U.S. Cl. ..... 123/41.21

[58] Field of Search ..... 123/41.2–41.27, 123/41.5

[56] References Cited

U.S. PATENT DOCUMENTS

| | | | |
|---|---|---|---|
| 1,676,045 | 7/1928 | Perry | 123/41.27 |
| 2,292,946 | 8/1942 | Karig | 123/41.08 |
| 3,168,080 | 2/1965 | Latterner et al. | 123/41.26 |
| 3,354,872 | 11/1967 | Gratzmuller | 123/41.2 |

*Primary Examiner*—William A. Cuchlinski, Jr.

*Attorney, Agent, or Firm*—Schwartz, Jeffery, Schwaab, Mack, Blumenthal & Evans

[57] ABSTRACT

In an evaporative cooling system including a coolant jacket of an engine, a condenser, a lower tank connected to the lower portion of the condenser and conduit means connecting these parts in this order to form a coolant circulation circuit, there is provided a capacity variable tank which is fluidly connected to the lower tank to temporarily capture therein air remaining in the coolant circulation circuit under operation of the cooling system.

14 Claims, 4 Drawing Figures

EVAPORATIVE COOLING SYSTEM OF INTERNAL COMBUSTION ENGINE

BACKGROUND OF THE INVENTION (1) Field of the Invention

The present invention relates in geneal to an engine cooling system of the type wherein the coolant is boiled so as to make use of the latent heat of vaporization thereof, and coolant vapor used as vehicle for removing heat from the engine, and more particularly to an improved air removing system therfor.

(2) Description of the Prior Art

Hithereto, a so-called evaporative cooling system (via., boiling liquid cooling system) has been proposed for achieving cooling of a combustion engine, such as internal combustion engine. This type cooling system basically features an arrangement wherein a liquid coolant (for example, water or a mixture of water and antifreeze or the like) in the coolant jacket of the engine is permitted to boil and the gaseous coolant (coolant vapor) thus produced is passed out to an air-cooled heat exchanger or condenser where the gaseous coolant is cooled or liquefied and then recirculated back into the coolant jacket of the engine. Due to the effective heat exchange carried out between the gaseous coolant in the condenser and the atmosphere surrounding the condenser, the cooling system exhibits a very high performance.

However, some of the evaporative cooling systems hiterto proposed have suffered from the drawback that during operation of the same, air unavoidably remaining in the system is forced to gather in the condenser thereby deteriorating the function of the same.

SUMMARY OF THE INVENTION

It is therefore an object of the present invention to provide an improved evaporative cooling system of an internal combustion engine, which can solve the abovementioned drawback.

According to the present invention, there is provided an evaporative cooling system of an internal combustion engine which comprises means defining in the engine a coolant jacket into which coolant is introduced in liquid state through an inlet port formed in the engine and from which the coolant is discharged in gaseous state through an outlet port formed in the engine, a condenser into which the gaseous coolant from the coolant jacket is introduced to be liquefied, a lower tank connected to the condenser to collect therein the coolant which is liquefied by the condenser, an electric pump by which the liquid coolant in the lower tank is pumped into the coolant jacket through the inlet port of the engine, conduit means connecting the outlet port, the condenser, the lower tank, the electric pump and the inlet port in this order to form a coolant circulation circuit, and a capacity variable tank fluidly connected to the lower tank to temporarily capture therein air remaining in the coolant circulation circuit under operation of the cooling system.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
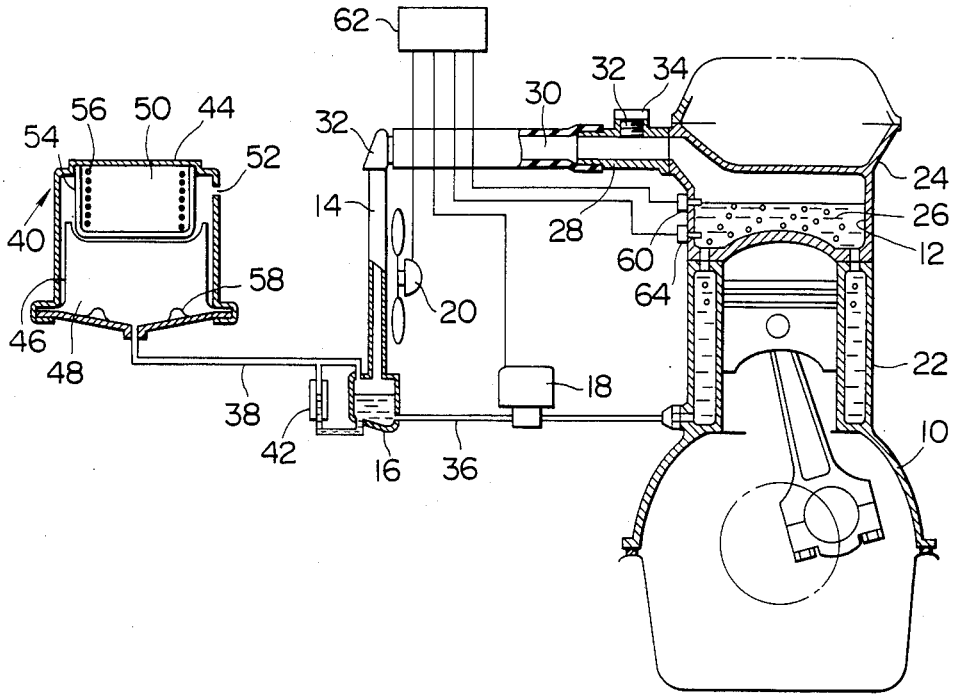
FIG. 1 is a schematical illustration of an embodiment of the present invention.

Referring to FIG. 1 of the drawings, there is shown an evaporative cooling system of a first embodiment of the present invention, which comprises generally an engine 10 having a coolant jacket 12 formed therein, a condenser 14, a lower tank 16 connected to the lower portion of the condenser 14, an electric pump 18 and an electric cooling fan 20 which are arranged and constructed in a manner as is described hereinnext.

The coolant jacket 12 comprises cavities respectively formed in a cylinder block 22 and a cylinder head 24. As will become more clear hereinafter, the coolant jacket 12 contains therein a liquid coolant (water) 26 which, under normal operation of the system, sufficiently covers the walls of the combustion chambers while maintaining the upper portion of the coolant jacket 12 empty of the liquid coolant. The liquid coolant 26 boils and evaporates when heated sufficiently by combustion heat of the engine 10, so that under normal operation of the engine, the upper portion of the jacket 12 is filled with coolant vapor.

The cylinder head 24 is provided with a vapor discharge port 28 from which a vapor conduit 30 exends to an inlet portion 32 of the condenser 14. As shown, the vapor discharge port 28 is formed with a coolant filler port 32 which is hermetically sealed by a removable cap 34.

The condenser 14 is mounted on the associated motor vehicle at the position where sufficient natural air draft is produced during moving of the vehicle, and the electric fan 20 is positioned adjacent the condenser 14, which, upon energization thereof, produces air flow positively passing through the condenser 14 to promote the condensation function of the same. The lower tank 16 collects therein the coolant liquefied by the condenser 14.

The capacity variable tank 40 comprises a casing 44 the interior of which is parted, by a bellowsphragm (viz., bellows-like diaphragm) 46, into first and second chambers 48 and 50, which are work and atmospheric chambers, respectively. As shown, the work chamber 48 is connected to the air conduit 38, while, the atmospheric chamber 50 is communicated with the atmosphere through an opening 52 formed in the casing 44. Disposed within the atmospheric chamber 50 is a cup-shaped spring seat 54 which is mounted on the major portion of the bellowsphragm 46 to move therewith. A spring 56 is disposed between the spring seat 54 and the casing 44 to bias the bellowsphragm 46 in a direction to expand the atmospheric chamber 50. The spring seat 54 is shaped and sized so as to prevent excessive deformation of the bellowsphragm 46. When, thus, the pressure in the work chamber 48 becomes greater than the sum of the atmospheric pressure and the biasing force created by the spring 56, the work chamber 48 expands thereby reducing the volume of the atmospheric chamber 50. However, by the provision of the cup-shaped spring seat 54, the maximum volume of the work chamber 48 is limited, as is seen from FIG. 1. Denoted by numeral 58 is a stopper which is secured to the bottom of the casing 44 to limit the downward movement of the bellowsphragm 46. Thus, minimum volume of the work chamber 48 is also limited by the provision of the stopper 58.

Disposed in the coolant jacket 12 of the engine 10 is a coolant level sensor 60 which detects whether the level of the liquid coolant in the coolant jacket 12 is at a predetermined level or not. That is, when, due to the continuous coolant evaporation in the jacket 12, the coolant level falls below the predetermined level, the signal issued by the sensor 60 brings about energization of the electric pump 18 thereby to feed the liquid coolant to the jacket 12 from the lower tank 16 of the condenser 14. More particularly, the operation of the electric pump 18 is controlled by a control unit 62 which is disclosed in Japanese Patent Application No. 58-22816 filed Dec. 2, 1983 in the name of Yoshinori HIRANO. With ths control, the coolant level in the coolant jacket 12 is kept substantially at the predetermined level during normal operation of the engine 10. It is to be noted that the entire amount of coolant used in the cooling system is so determined that when the coolant jacket 12 of the engine proper 10 contains therein the coolant 26 to the level of the coolant level sensor 60, the lower tank 16 is allowed to contain therein a predetermined amount of remaining coolant, as may be understood from FIG. 1.

A temperature sensor 64 is disposed also in the coolant jacket 12 to detect the temperature of the coolant therein. Receiving signals from the temperature sensor 64 and the other sensors (not shown), such as engine speed sensor, throttle opening angle sensor and fuel supply rate sensor, the control unit 62 controls the operation of the electric fan 20 so as to allow the engine proper 10 to have a desirable temperature (that is, the temperature of the liquid coolant in the engine) in accordance with the operation mode of the engine.

Under operation of the cooling system, the system as a whole is hermetically closed, so that changing the pressure in the system induces variation in the boiling point of the liquid coolant contained therein. When, for example, the engine 10 is under low load condition wherein heat generated by the engine 10 is relatively small, the control unit 62 controls the electric fan 20 to produce a less amount of air flow per unit time (in practice, the control unit 62 stops the fan 20) to lower the condensation function of the condenser 14. With this operation, the pressure in the system becomes higher than the atmospheric value increasing the boiling point of the liquid coolant in the system to a certain value, so that the temperature of the coolant 26 in the coolant jacket 12 can be kept at relatively high degree (for example, 120° C.) thereby increasing the thermal efficiency of the engine 10.

When, on the contrary, the engine 10 is under high load condition wherein heat generated by the engine 10 is relatively high, the control unit 62 controls the electric fan 20 to produce a greater amount of air flow per unit time (in practice, the control unit 62 continues energization of the fan 20) to promote the condensation function of the condenser 14. With this, the pressure in the system becomes lower than the atmospheric pressure lowering the boiling point of the coolant in the system, so that the temperature of the coolant in the coolant jacket 12 is kept at relatively low level (for example, 90° C.) thereby preventing abnormal combustion of the engine 10.

In the following, operation of the capacity variable tank 40 will be described in accordance with the operation of the cooling system.

Figure 2:
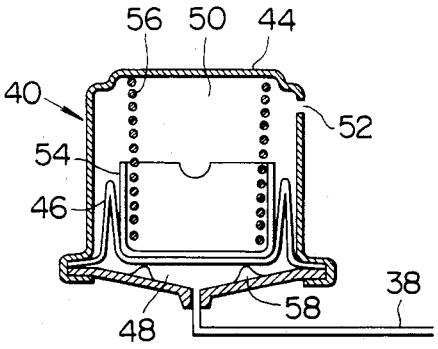
FIG. 2 is a view of a capacity variable tank used in the embodiment, showing a condition different from that shown in FIG. 1.

Under standstill of the engine 10, the cooling system contains therein a certain amount of liquid coolant 26, that is, the coolant jacket 12 of the engine 10 and the condenser 14 contain the coolant to a level lower than the level determined by the coolant level sensor 60. Under this condition, the work chamber 48 of the tank 40 keeps its minimum volume condition, as shown in FIG. 2, because of lack of air fed thereinto from the lower tank, as will be understood hereinafter.

When the engine 10 starts, the temperature of the coolant in the coolant jacket 12 is gradually increased by the combustion heat of the engine 10 and at the same time, the electric pump 18 is energized to feed the liquid coolant from the condenser 14 (and thus, the lower tank 16) to the coolant jacket 12 to the level determined by the level sensor 60. With this operation, the interior of the condenser 14 and the upper portion of the lower tank 16, as well as the upper portion of the coolant jacket 12 and the interior of the vapor conduit 30, become empty of the liquid coolant.

Figure 3:
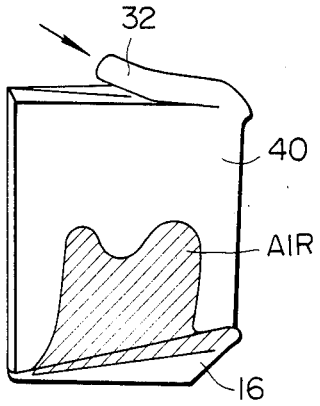
FIG. 3 is a view of a condenser in a condition wherein air gathers therein.

When, thereafter, the temperature of the liquid coolant 26 in the coolant jacket 12 increases to a predetermined degree, the coolant 26 starts boiling so that the coolant vapor thus produced flows toward the condenser 14 through the vapor conduit 30. Due to generation of the coolant vapor and thus due to increase in pressure in the empty portion of the cooling system, any air remaining in the empty portion is obliged to flow into the work chamber 48 of the tank 40 and is captured in the same. The manner in which air is captured by the work chamber 48 of the tank 40 is illustrated in FIG. 3. This view is taken by means of an infrared photography. Although some of the coolant vapor flows into the work chamber 48 of the tank 40, it is instantly cooled and thus liquefied and thus flows back to the lower tank 16 of the condenser 14. The work chamber 48, thus, expands in proportion to the amount of air introduced thereinto against the counterforce created by the atmosphere and the spring 56.

It is thus to be noted that now, air remaining in the essential circuit of the cooling system is removed or at least minimized by the capacity variable tank 40. Thus, thereafter, the condenser 14 is prevented from being interrupted by air, so that it can exhibit its essential function to the coolant vapor fed thereinto. That is to say, the condenser 14 can carry out effective heat exchange between the atmosphere surrounding the condenser 14 and the gaseous coolant (viz., coolant vapor) in the condenser 14.

As will be easily understood from the drawin9 (FIG. 1), the work chamber 48 as well as the essential part of the cooling system are hermetically closed from the atmosphere. Thus, the system does not permit escape of the coolant vapor therefrom into the atmosphere thereby needing no supplementary feeding of the coolant thereinto or at least minimizing the feeding.

When, thereafter, the engine 10 stops, the temperature of the interior of the system is gradually lowered and thus the coolant vapor in the system is gradually condensed or liquefied thereby lowering the pressure in the cooling system. However, in accordance with reduction in pressure in the system, the air reserved in the work chamber 48 of the capacity variable tank 40 is introduced into the system, so that the interior of the cooling system is prevented from becoming negative in pressure.

Figure 4:
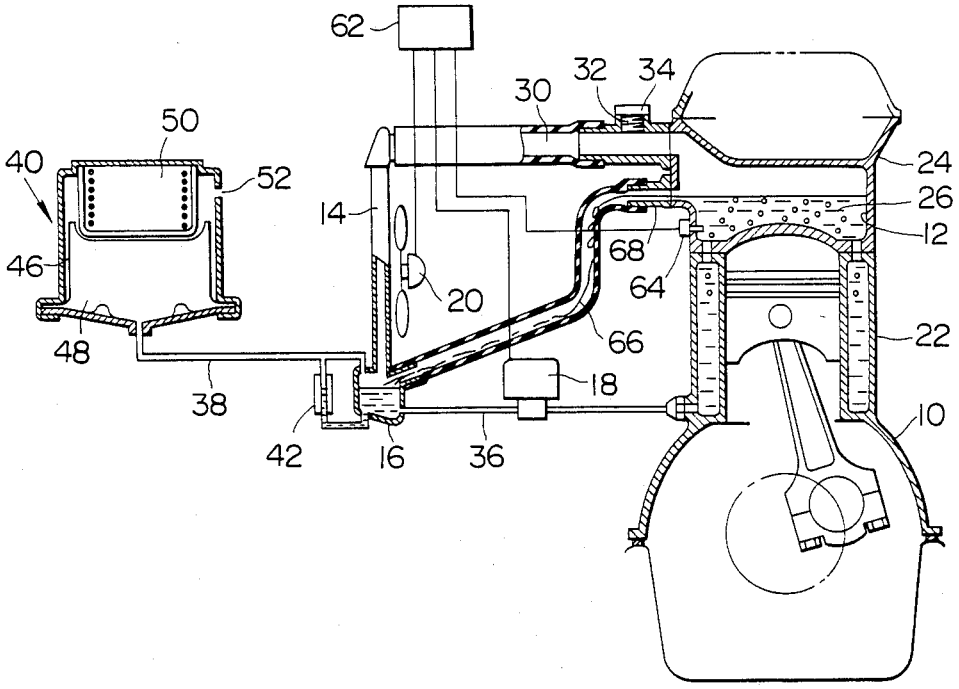
FIG. 4 is a view similar to FIG. 1, but showing another embodiment of the present invention.

Referring to FIG. 4, there is shown a second embodiment of the present invention, which comprises substantially the same parts as those in the first embodiment of FIG. 1 except for several parts. Thus, the same parts are denoted by the same numerals and description of them will be omitted from the following.

In the second embodiment, an overflow conduit 66 is employed in place of the coolant level detecting means (viz.. the coolant level sensor 60) of the first embodiment. As is shown in the drawing, an upper end of the overflow conduit 66 is connected to an oveflow port 68 which is formed on the cylinder head 24 at the location corresonding to that to which the afore-mentioned coolant level sensor (60) is mounted. The lower end of the overflow conduit 66 is connected to the upper portion of the lower tank 16.

When the temperature of the liquid coolant 26 reaches to its boiling point after start of the engine 10, the control unit 62 energizes the electric pump 18 to continuously feed the liquid coolant 26 in the lower tank 16. By the provision of the overflow conduit 66, the liquid coolant overflowed due to continuous introduction of the same into the coolant jacket 12 flows down to the lower tank 40 thereby keeping the amount of coolant in the coolant jacket 12 constant. In this second embodiment, the engine warm up is carried out in a short time because only the minimum of liquid coolant 12 is contained in the coolant jacket 12 even during the engine warm up period.

As will be understood from the foregoing description, according to the present invention, the air remaining in the essential circuit of the evaporative cooling system can be temporarily captured by the separate capacity variable tank 40 during normal operation of the system. Thus, the condenser 14 can exhibit its essential heat exchanging function during operation of the system.

Furthermore, since the entire system is hermetically closed from the atmosphere, there is no substantial escape of coolant to the atmosphere during operation of the system and thus the system can be used for a long time without need of supplementary feeding of coolant thereinto. Furthermore, by the hermetically closed construction of the system, it is possible to change the boiling point of of the coolant by varying the amount of air flow directed toward the condenser 14 by the electric fan 20. This induces easy controlling of engine temperature in accordance with the mode at which the engine operates.

What is claimed is:

1. An evaporative cooling system of an internal combustion engine, comprising:

means defining in the engine a coolant jacket into which coolant is introduced in liquid state through an inlet port formed in the engine and from which the coolant is discharged in gaseous state through an outlet port formed in the engine;

a condenser into which the gaseous coolant from the coolant jacket of the engine is introduced to be liquefied;

a lower tank connected to said condenser to collect therein the coolant which has been liquefied by said condenser, said lower tank having a bottom which is submerged in the liquefied coolant;

an electric pump by which the liquid coolant in said lower tank near the bottom of the same is pumped into the coolant jacket through said inlet port of the engine;

conduit means connecting said outlet port, said condenser, said lower tank, said electric pump and said inlet port thereby to form a coolant circulation circuit; and a capacity variable tank fluidly connected through a conduit to said lower tank to temporarily capture therein air remaining in said coolant circulation circuit during operation of the cooling system, said conduit being connected to an upper portion of said tank, said upper portion being empty of the liquid coolant under normal operation of the cooling system.

2. An evaporative cooling system as claimed in claim 1, in which said capacity variable tank comprises:

a casing; and a diaphragm operatively disposed in said casing to part the interior of the same into first and second chambers which are respectively connected to the interior of said lower tank and the atomosphere.

3. An evaporative cooling system as claimed in claim 1, further comprising coolant level keeping means for keeping the coolant level in said coolant jacket at a predetermined level under normal operation of said cooling system.

4. An evaporative cooling system as claimed in claim 3, in which said coolant level keeping means comprises an coolant level sensor which is disposed in the coolant jacket of a cylinder head of the engine at a position where the coolant level appears under normal operation of the system.

5. An evaporative cooling system as claimed in claim 3, in which said coolant level keeping means comprises an overflow conduit which has one end connected to the coolant jacket of a cylinder head of said engine at a position where the coolant level in said coolant jacket appears under normal operation of said system and the other end connected to said upper portion of said lower tank.

6. An evaporative cooling system as claimed in claim 3, further comprising a coolant temperature controlling means which comprises:

a temperature sensor disposed in the coolant jacket of a cylinder head at the portion which is submerged in the liquid coolant under normal operation of the system:

an electric fan positioned adjacent to said condenser to produce, when electrically energized, an air flow which is passed through said condenser to promote the function of the same; and control means for controlling operation of said electric fan in accordance with an information signal issued from said temperature sensor.

7. An evaporative cooling system for an internal combustion engine, comprising: into means defining in the engine a coolant jacket into which coolant is introduced in liquid state through an inlet port formed in the engine and from which the coolant is discharged in gaseous state thrugh an outlet port formed in the engine;

a condenser into which the gaseous coolant from the coolant jacket of the engine is introduced to be liquefied;

a lower tank connected to said condenser to collect therein the coolant which is liquefied by said condenser;

an electric pump by which the liquid coolant in said lower tank is pumped into the coolant jacket through said inlet port of the engine;

conduit means connecting said outlet port, said condenser, said lower tank, said electric pump and said inlet port in this order to form a coolant circulation circuit;

a capacity variable tank fluidly connected to said lower tank to temporarily capture therein air remaining in said coolant circulation circuit during operation of the cooling system, said capacity variable tank being connected to an upper portion of said lower tank, said upper portion being empty of the liquid coolant under normal operation of said cooling system, wherein said capacity variable tank comprises:

a casing; and a diaphragm operatively disposed in said casing to part the interior of the same into first and second chambers which are respectively connected to the interior of said lower tank and the atmosphere.

8. An evaporative cooling system as claimed in claim 7 in which said capacity variable tank further comprises biasing means by which said diaphragm is biased in a direction to reduce the volume of said first chamber.

9. An evaporative cooling system as claimed in claim 8, in which said biasing means comprises:

a coil spring disposed in said second chamber: and a cup-shaped spring seat disposed on the major portion of said diaphragm to move therewith, said coil spring being compressed between an inside wall of said casing and said spring seat.

10. An evaporative cooling system as claimed in claim 9, in which said capacity variable tank further comprises a stopper which is disposed on an inside wall of said casing to limit the movement of the major portion of said diaphragm in a direction to reduce the volume of said first chamber.

11. An evaporative cooling system as claimed in claim 9, in which said cup-shaped spring seat is shaped and sized so as to prevent excessive deformation of said diaphragm upon expansion of said first chamber.

12. An evaporative cooling system for an internal combustion engine, comprising:

means defining in the engine a coolant jacket into which coolant is introduced in liquid state through an inlet port formed in the engine and from which the coolant is discharged in gaseous state through an outlet port formed in the engine;

a condenser into which the gaseous coolant from the coolant jacket of the engine is introduced to be liquefied;

a lower tank connected to said condenser to collect therein the coolant which is liquified by said condenser;

an electric pump by which the liquid coolant in said lower tank is pumped into the coolant jacket through said inlet port of the engine;

conduit means connecting said outlet port, said condenser, said lower tank, said electric pump and said inlet port in this order to form a coolant circulation circuit;

a capacity variable tank fluidly connected to said lower tank to temporarily capture therein air remaining in said coolant circulation circuit during operation of the cooling system, said capacity variable tank being connected to an upper portion of said lower tank, said upper portion being empty of the liquid coolant under normal operation of said cooling system; and coolant level keeping means for keeping the coolant level in said coolant jacket at a predetermined level under normal operation of said cooling system, said coolant level keeping means comprising a coolant level sensor which is disposed in the coolant jacket of a cylinder head of the engine at a position where the coolant level appears under normal operation of the system.

13. An evaporative cooling system for an internal combustion engine, comprising:

means defining in the engine a coolant jacket into which coolant is introduced in liquid state through an inlet port formed in the engine and from which the coolant is discharged in gaseous state through an outlet port formed in the engine;

a condenser into which the gaseous coolant from the coolant jacket of the engine is introduced to be liquefied;

a lower tank connected to said condenser to collect therein the coolant which is liquified by said condenser;

an electric pump by which the liquid coolant in said lower tank is pumped into the coolant jacket through said inlet port of the engine;

conduit means connecting said outlet port, said condenser, said lower tank, said electric pump and said inlet port in this order to form a coolant circulation circuit;

a capacity variable tank fluidly connected to said lower tank to temporarily capture therein air remaining in said coolant circulation circuit during operation of the cooling system, said capacity variable tank being connected to an upper portion of said lower tank, said upper portion being empty of the liquid coolant under normal operation of said cooling system; and coolant level keeping means for keeping the coolant level in said coolant jacket at a predetermined level under normal operation of said cooling system, said coolant level keeping means including an overflow conduit which has one end connected to the coolant jacket of a cylinder head of said engine at a position where the coolant level in said coolant jacket appears under normal operation of said system and the other end connected to said upper portion of said lower tahk.

14. An evaporative cooling system for an internal combustion engine, comprising:

means defining in the engine a coolant jacket into which coolant is introduced in liquid state through an inlet port formed in the engine and from which the coolant is discharged in gaseous stage through an outlet port formed in the engine;

a condenser into which the gaseous coolant from the coolant jacket of the engine is introduced to be liquefied;

a lower tank connected to said condenser to collect therein the coolant which is liquified by said condenser;

EVAPORATIVE COOLING SYSTEM OF INTERNAL COMBUSTION ENGINE

BACKGROUND OF THE INVENTION (1) Field of the Invention

The present invention relates in geneal to an engine cooling system of the type wherein the coolant is boiled so as to make use of the latent heat of vaporization thereof, and coolant vapor used as vehicle for removing heat from the engine, and more particularly to an improved air removing system therfor.

(2) Description of the Prior Art

Hithereto, a so-called evaporative cooling system (via., boiling liquid cooling system) has been proposed for achieving cooling of a combustion engine, such as internal combustion engine. This type cooling system basically features an arrangement wherein a liquid coolant (for example, water or a mixture of water and antifreeze or the like) in the coolant jacket of the engine is permitted to boil and the gaseous coolant (coolant vapor) thus produced is passed out to an air-cooled heat exchanger or condenser where the gaseous coolant is cooled or liquefied and then recirculated back into the coolant jacket of the engine. Due to the effective heat exchange carried out between the gaseous coolant in the condenser and the atmosphere surrounding the condenser, the cooling system exhibits a very high performance.

However, some of the evaporative cooling systems hiterto proposed have suffered from the drawback that during operation of the same, air unavoidably remaining in the system is forced to gather in the condenser thereby deteriorating the function of the same.

SUMMARY OF THE INVENTION

It is therefore an object of the present invention to provide an improved evaporative cooling system of an internal combustion engine, which can solve the abovementioned drawback.

According to the present invention, there is provided an evaporative cooling system of an internal combustion engine which comprises means defining in the engine a coolant jacket into which coolant is introduced in liquid state through an inlet port formed in the engine and from which the coolant is discharged in gaseous state through an outlet port formed in the engine, a condenser into which the gaseous coolant from the coolant jacket is introduced to be liquefied, a lower tank connected to the condenser to collect therein the coolant which is liquefied by the condenser, an electric pump by which the liquid coolant in the lower tank is pumped into the coolant jacket through the inlet port of the engine, conduit means connecting the outlet port, the condenser, the lower tank, the electric pump and the inlet port in this order to form a coolant circulation circuit, and a capacity variable tank fluidly connected to the lower tank to temporarily capture therein air remaining in the coolant circulation circuit under operation of the cooling system.

BRIEF DESCRIPTION OF THE DRAWINGS

Other objects and advantages of the present invention will become apparent from the following description when taken in conjunction with the accompanying drawings, in which:

FIG. 1 is a schematical illustration of an embodiment of the present invention;

FIG. 2 is a view of a capacity variable tank used in the embodiment, showing a condition different from that shown in FIG. 1;

FIG. 3 is a view of a condenser in a condition wherein air gathers therein; and

FIG. 4 is a view similar to FIG. 1, but showing another embodiment of the present invention.

DETAILED DESCRIPTION OF THE INVENTION

Referring to FIG. 1 of the drawings, there is shown an evaporative cooling system of a first embodiment of the present invention, which comprises generally an engine 10 having a coolant jacket 12 formed therein, a condenser 14, a lower tank 16 connected to the lower portion of the condenser 14, an electric pump 18 and an electric cooling fan 20 which are arranged and constructed in a manner as is described hereinnext.

The coolant jacket 12 comprises cavities respectively formed in a cylinder block 22 and a cylinder head 24. As will become more clear hereinafter, the coolant jacket 12 contains therein a liquid coolant (water) 26 which, under normal operation of the system, sufficiently covers the walls of the combustion chambers while maintaining the upper portion of the coolant jacket 12 empty of the liquid coolant. The liquid coolant 26 boils and evaporates when heated sufficiently by combustion heat of the engine 10, so that under normal operation of the engine, the upper portion of the jacket 12 is filled with coolant vapor.

The cylinder head 24 is provided with a vapor discharge port 28 from which a vapor conduit 30 exends to an inlet portion 32 of the condenser 14. As shown, the vapor discharge port 28 is formed with a coolant filler port 32 which is hermetically sealed by a removable cap 34.

The condenser 14 is mounted on the associated motor vehicle at the position where sufficient natural air draft is produced during moving of the vehicle, and the electric fan 20 is positioned adjacent the condenser 14, which, upon energization thereof, produces air flow positively passing through the condenser 14 to promote the condensation function of the same. The lower tank 16 collects therein the coolant liquefied by the condenser 14.

The capacity variable tank 40 comprises a casing 44 the interior of which is parted, by a bellowsphragm (viz., bellows-like diaphragm) 46, into first and second chambers 48 and 50, which are work and atmospheric chambers, respectively. As shown, the work chamber 48 is connected to the air conduit 38, while, the atmospheric chamber 50 is communicated with the atmosphere through an opening 52 formed in the casing 44. Disposed within the atmospheric chamber 50 is a cup-shaped spring seat 54 which is mounted on the major portion of the bellowsphragm 46 to move therewith. A spring 56 is disposed between the spring seat 54 and the casing 44 to bias the bellowsphragm 46 in a direction to expand the atmospheric chamber 50. The spring seat 54 is shaped and sized so as to prevent excessive deformation of the bellowsphragm 46. When, thus, the pressure in the work chamber 48 becomes greater than the sum of the atmospheric pressure and the biasing force created by the spring 56, the work chamber 48 expands thereby reducing the volume of the atmospheric chamber 50. However, by the provision of the cup-shaped